US007281953B1

(12) United States Patent
Jochym et al.

(10) Patent No.: US 7,281,953 B1
(45) Date of Patent: Oct. 16, 2007

(54) COMPUTER CARD ADAPTER

(75) Inventors: Daniel A. Jochym, Downingtown, PA (US); Joseph J. Scorsone, West Chester, PA (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 11/198,503

(22) Filed: Aug. 5, 2005

(51) Int. Cl.
*H01R 33/88* (2006.01)

(52) U.S. Cl. ..... 439/638; 439/77; 361/749

(58) Field of Classification Search ..... 439/77, 439/502–504, 638; 361/749, 776, 789; 174/254
See application file for complete search history.

(56) References Cited

U.S. PATENT DOCUMENTS 5,779,496 A * 7/1998 Bolinger et al. ..... 439/377
5,805,422 A * 9/1998 Otake et al. ..... 361/749
6,404,626 B1 * 6/2002 Low et al. ..... 361/686
6,705,005 B1 * 3/2004 Blazier et al. ..... 29/846
6,829,490 B2 * 12/2004 Nakamura et al. ..... 455/550.1

* cited by examiner

*Primary Examiner*—Khiem Nguyen
(74) *Attorney, Agent, or Firm*—Richard J. Gregson; RatnerPrestia

(57) ABSTRACT

Methods and apparatus to configure a computer to receive cards of a first or second card type are disclosed. The computer is configured through the use of an adapter including a flexible cable having a first connector adjacent one end and a second connector adjacent the other end. The computer is configured by coupling the first connector to the computer. Also, a determination is made to receive either the first or the second card types. For a determination to receive the first card type, the flexible cable is bent in a predefined manner to orient the second connector with respect to the first connector to receive the first card type. For a determination to receive the second card type, the flexible cable is bent in another predefined manner to orient the second connector differently with respect to the first connector to receive the second card type.

8 Claims, 10 Drawing Sheets

COMPUTER CARD ADAPTER

FIELD OF THE INVENTION

The present invention relates to the field of computers and, more particularly, to accommodating different forms of computer cards (herein cards) within a computer.

BACKGROUND OF THE INVENTION

Computers typically include cards that enable the computers to perform additional functions. For example, a card may be inserted into a computer to provide a communication interface between the computer and another computer or electronic device. It is often desirable to insert cards or replace cards with new and/or different cards to provide improved and/or different functions.

The cards are typically mounted within the housing of a computer and are accessed by external devices through openings in the enclosure. There are two main types of cards. A first card type includes a computer interface connector on an edge of the card that is adjacent an edge of the card that is nearest the opening through which the card is accessed. A second card type includes a computer interface connector on an edge of the card that is opposite the edge of the card that is nearest the opening through which the card is accessed.

A computer is typically configured to accept only one card type. Thus, if the computer is configured to accept the first card type, it is unable to accept the second card type, and vice versa. This problem is further exacerbated by the fact that not all cards are available in both card types.

Accordingly, improved methods and apparatus are needed for accommodating cards that are not subject to the above limitations. The present invention addresses this need among others.

SUMMARY OF THE INVENTION

The present invention is embodied in methods and apparatus to configure a computer to receive cards of a first or second card type. The computer is configured through the use of an adapter including a flexible cable having a first connector adjacent one end and a second connector adjacent the other end. The computer is configured by coupling the first connector to the computer. Also, a determination is made to receive either the first or the second card types. For a determination to receive the first card type, the flexible cable is bent in a predefined manner to orient the second connector with respect to the first connector to receive the first card type. For a determination to receive the second card type, the flexible cable is bent in another predefined manner to orient the second connector differently with respect to the first connector to receive the second card type.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Figure 1A:
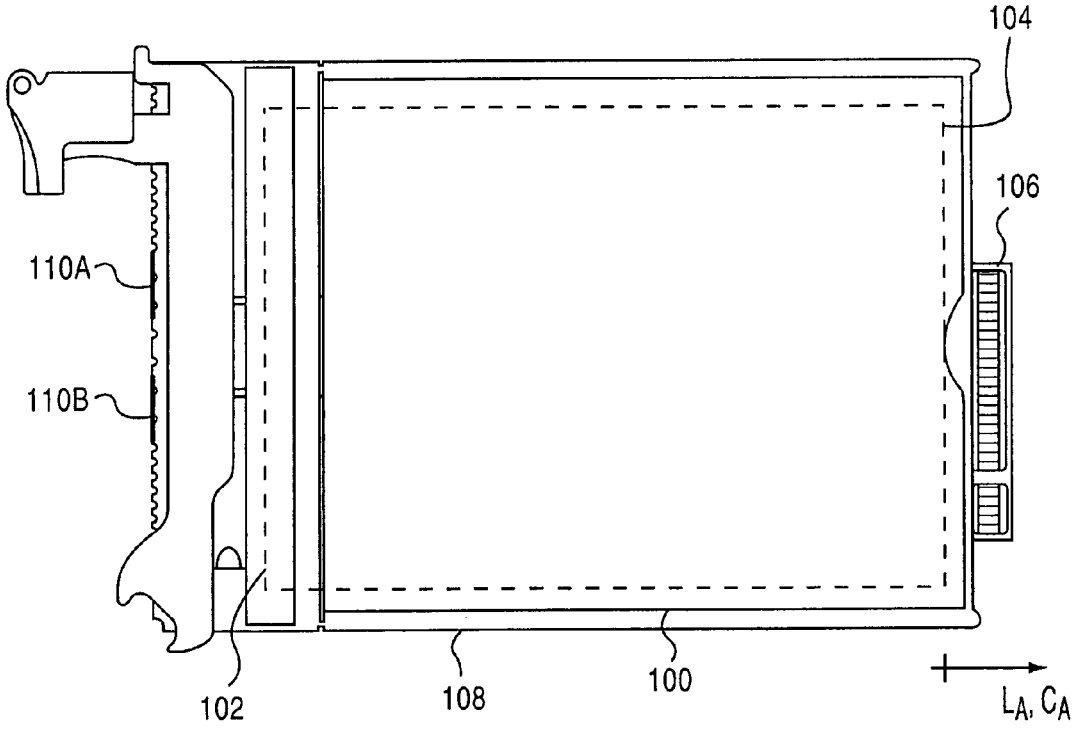
FIG.1A (PRIOR ART)
FIG. 1A is a side view of a prior art card type within a housing for use in a computer in accordance with an aspect of the present invention.

Preferred features of selected embodiments of this invention will now be described with reference to the figures. It is contemplated that any of the configurations and materials described hereafter can be modified within the scope of this invention.

Referring to the figures generally, in an exemplary embodiment of the present invention, an adapter 300 for use with a computer 600 is provided. The adapter 300 includes a first connector 308 and a second connector 310. In addition, the adapter 300 includes a flexible cable 302 having a first end 304 and a second end 306. The first connector 308 is coupled to the flexible cable 302 adjacent the first end 304 and the second connector 310 is coupled to the flexible cable 302 adjacent the second end 306. In an exemplary embodiment, the flexible cable 302 including a first set of at least one predefined bend (318 and 320) for orienting the second connector 310 in a first orientation 400 with respect to the first connector 308 and a second set of at least one predefined bend (318, 320, 322, and 324) for orienting the second connector 310 in a second orientation 500 with respect to the first connector 308. The first orientation 400 and second orientation 500 are different.

In an exemplary embodiment of the present invention, a computer 600 is also provided. The computer 600 is configurable to receive one or more cards 100/200 having at least a first card type and a second card type. Each card 100/200 has a card connector 106/208, a longitudinal axis ($L_A$), and a connection axis ($C_A$) for the card connector 106/208. The longitudinal axis extends between a first edge 102/202 of the cards 100/200 and a second edge 104/204 of the cards 100/200 substantially perpendicular to the first and second card edges. The connection axis is substantially parallel to the longitudinal axis for cards 100 of the first card type and substantially perpendicular to the longitudinal axis for cards 200 of the second card type.

The computer 600 includes a housing 602, an adapter 300, a first support structure 606, and a second support structure 608. The adapter 300 includes a flexible cable 302 having a first end 304 and a second end 306 with a first connector 308 coupled adjacent the first end 308 for connection within the computer 600 and a second connector 310 coupled adjacent the second end 306 for connection to the card connector 106/208 of a card 100/200 when the card 100/200 is received by the computer 600 along the connection axis. Additionally, the adapter 300 may include a support member 312 coupled to the flexible cable 302 adjacent the second end to orient the second connector 310.

The first support structure 606 is coupled to the housing 602 and is configured to support the support member 312 such that the second connector 310 is oriented to receive the first card type card connectors 106 when the first card type 100 is received by the computer 600 along the first card type connection axis. The second support structure 608 is coupled to the housing 602 and is configured to support the support member 312 such that the second connector 310 is oriented to receive the second card type card connectors 208 when the second card type 200 is received by the computer 600 along the second card type connection axis.

In an exemplary embodiment, a method for configuring a computer 600 to receive cards 100/200 of either a first type or a second type using an adapter 300 is also provided. The cards 100/200 have card connectors 106/208. The method includes a step 702 of coupling an adapter to the computer, the adapter including a flexible cable having a first end and a second end, a first connector adjacent the first end for connection to the computer when the adapter is coupled to the computer, a second connector adjacent the second end, and a support member adjacent the second end that orients the second connector. The method also includes a step 704 of determining whether to configure the computer to receive the first card type or to receive the second card type. The method also includes a step 706 of orienting the flexible cable in a first orientation and mounting the support member to a first support structure within the computer based on a determination to configure the computer to receive the first card type such that the second connector is oriented to receive the first card type card connectors when the first card type is received within the computer. The method also includes a step 708 of orienting the flexible cable in a second orientation and mounting the support member to a second support structure within the computer based on a determination to configure the computer to receive the second card type such that the second connector is oriented to receive the second card type card connectors when the second card type is received within the computer.

The figures are now described individually. FIG. 1A depicts a first type of exemplary card 100 for insertion within a computer (described below) in accordance with aspects of the present invention. The card 100 has a first edge 102 and a second edge 104 opposite the first edge 102. A longitudinal axis ($L_A$) extends between the first edge 102 and the second edge 104. A card connector 106 extends from the second edge 104 for mating to a corresponding card mating connector within a computer, thereby establishing a communication connection with the computer. As described in further detail below, the card 100 is coupled to the computer along a connection axis ($C_A$) for the card connector 106 to engage the card connector 106 with the corresponding card mating connector of the computer. The longitudinal axis ($L_A$) and the connection axis ($C_A$) of the card 100 are substantially parallel.

In an exemplary embodiment, the card 100 is covered by a housing 108 and is connected to one or more external connectors (represented by a first external connector 110*a* and a second external connector 110*b*) that are coupled to the card 100. In the illustrated embodiment, the housing 108 supports the external connectors 110. The external connectors 110 provide connection ports for establishing connections to external devices such as other computers and/or an electronic devices, e.g., a printer (not shown). In an alternative exemplary embodiment, the card 100 is not covered by a housing 108 and/or in not connected to the one or more external connectors 110. The card 100 covered by the housing 108 may be a Peripheral Component Interface Express (PCIe) ExpressModule assembly in accordance with the PCIe ExpressModule specification developed by PCI-SIG®, a special interest group responsible for PCIe industry-standard I/O technology. Other suitable cards will be understood by one of skill in the art from the description herein.

Figure 1B:
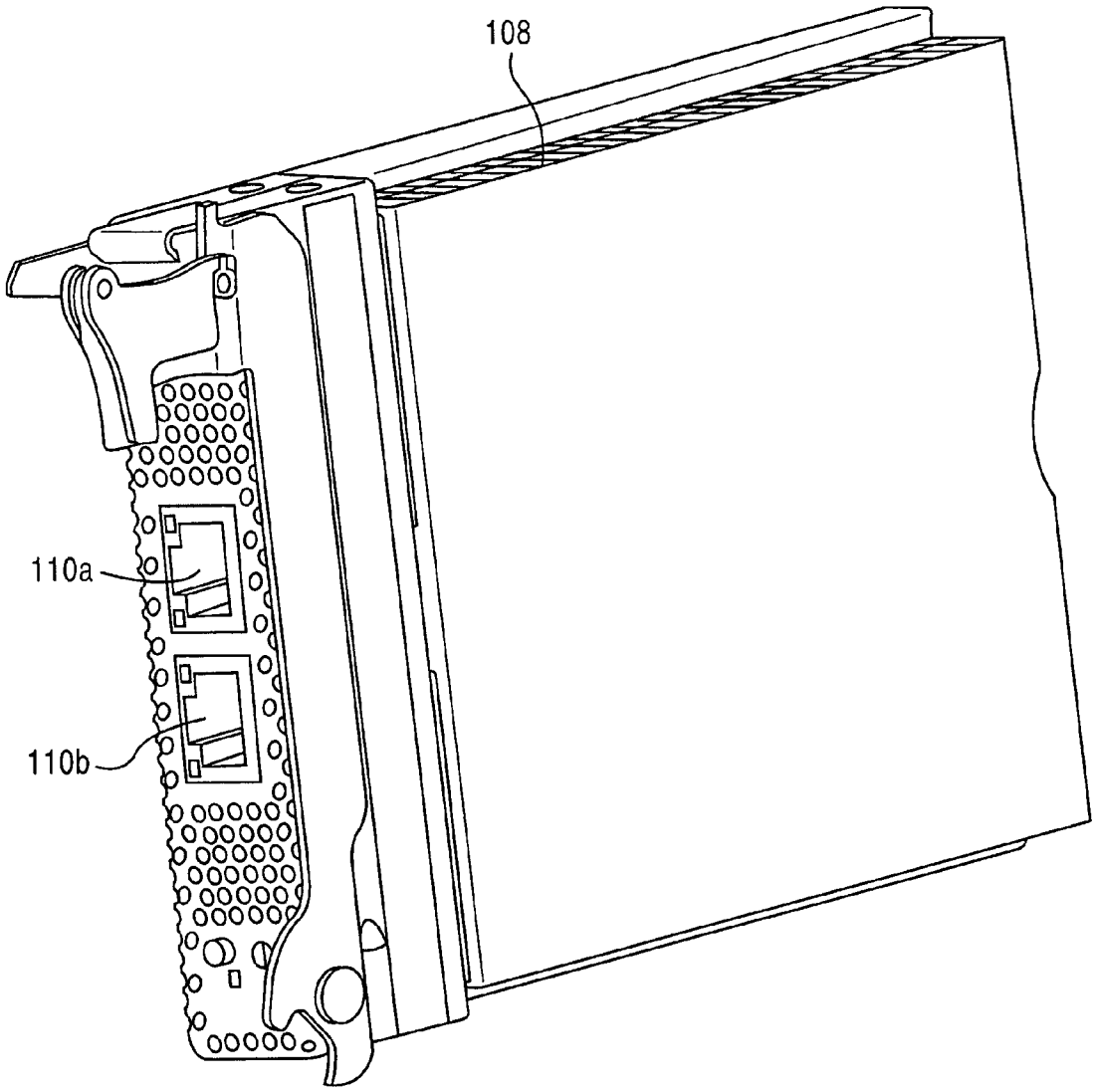
FIG.1B (PRIOR ART)
FIG. 1B is a perspective view of the housing for the card type of FIG. 1A.
Figure 2:
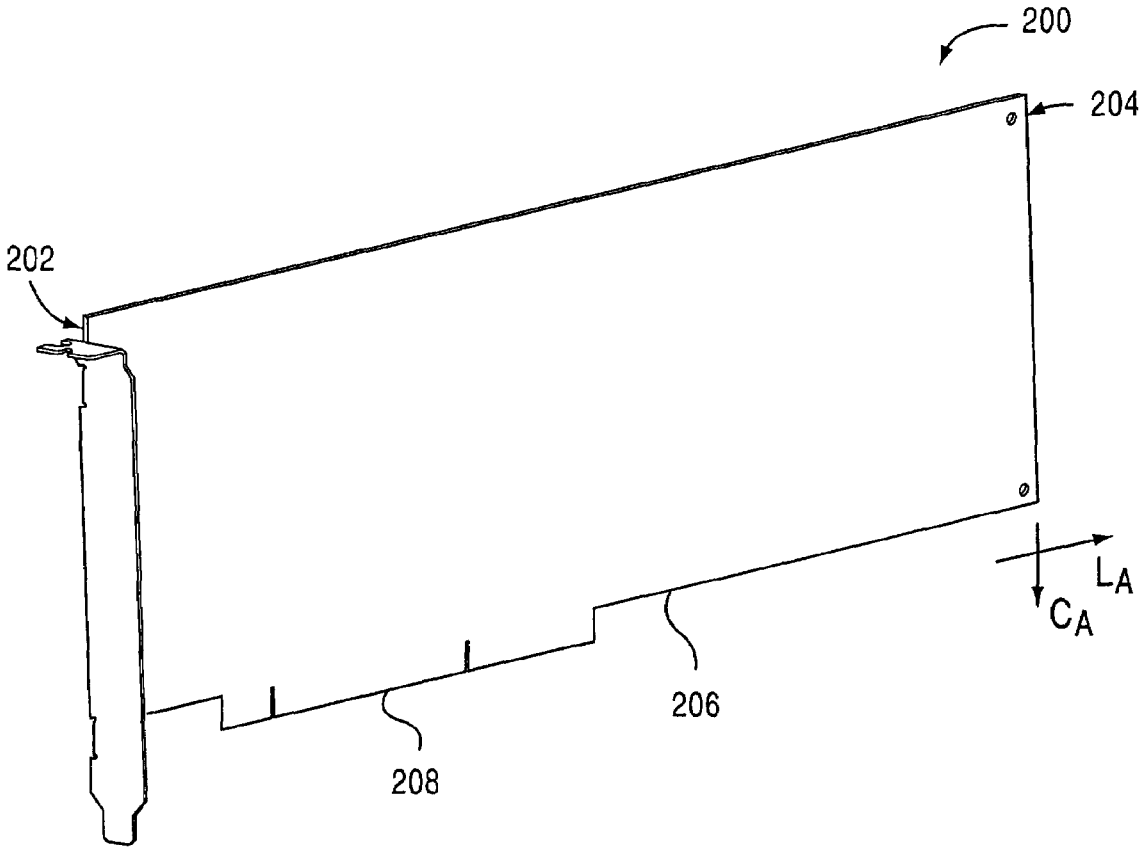
FIG.2 (PRIOR ART)
FIG. 2 is a perspective view of another prior art card type for use in a computer in accordance with an aspect of the present invention.

FIG. 2 depict a second type of exemplary card 200 for insertion within a computer in accordance with aspects of the present invention. The card 200 has a first edge 202 and a second edge 204 opposite the first edge 202. A longitudinal axis ($L_A$) extends between the first edge 202 and the second edge 204. Additionally, the card 200 has a third edge 206 substantially perpendicular to the first edge 202 and the second edge 204. A card connector 208 extends from the third edge 206 for mating to a corresponding card mating connector within a computer, thereby establishing a communication connection with the computer. As described in further detail below, the card 200 is coupled to the computer along a connection axis ($C_A$) for the card connector 208 to engage the card connector 208 with the corresponding card mating connector of the computer. The longitudinal axis ($L_A$) and the connection axis ($C_A$) of the card 200 are substantially perpendicular. In an exemplary embodiment, the card connector 208 is substantially the same as the card connector 106 of the card 100 (FIGS. 1A and 1B).

In an exemplary embodiment, the card 200 is covered by a housing and is connected to one or more external connectors (not shown). In an alternative exemplary embodiment, the card 100 is not covered by a housing 108 and/or is not connected to one or more external connectors. The card 200 may be a Peripheral Component Interface Express (PCIe) card. Other suitable cards will be understood by one of skill in the art from the description herein.

Figure 3:
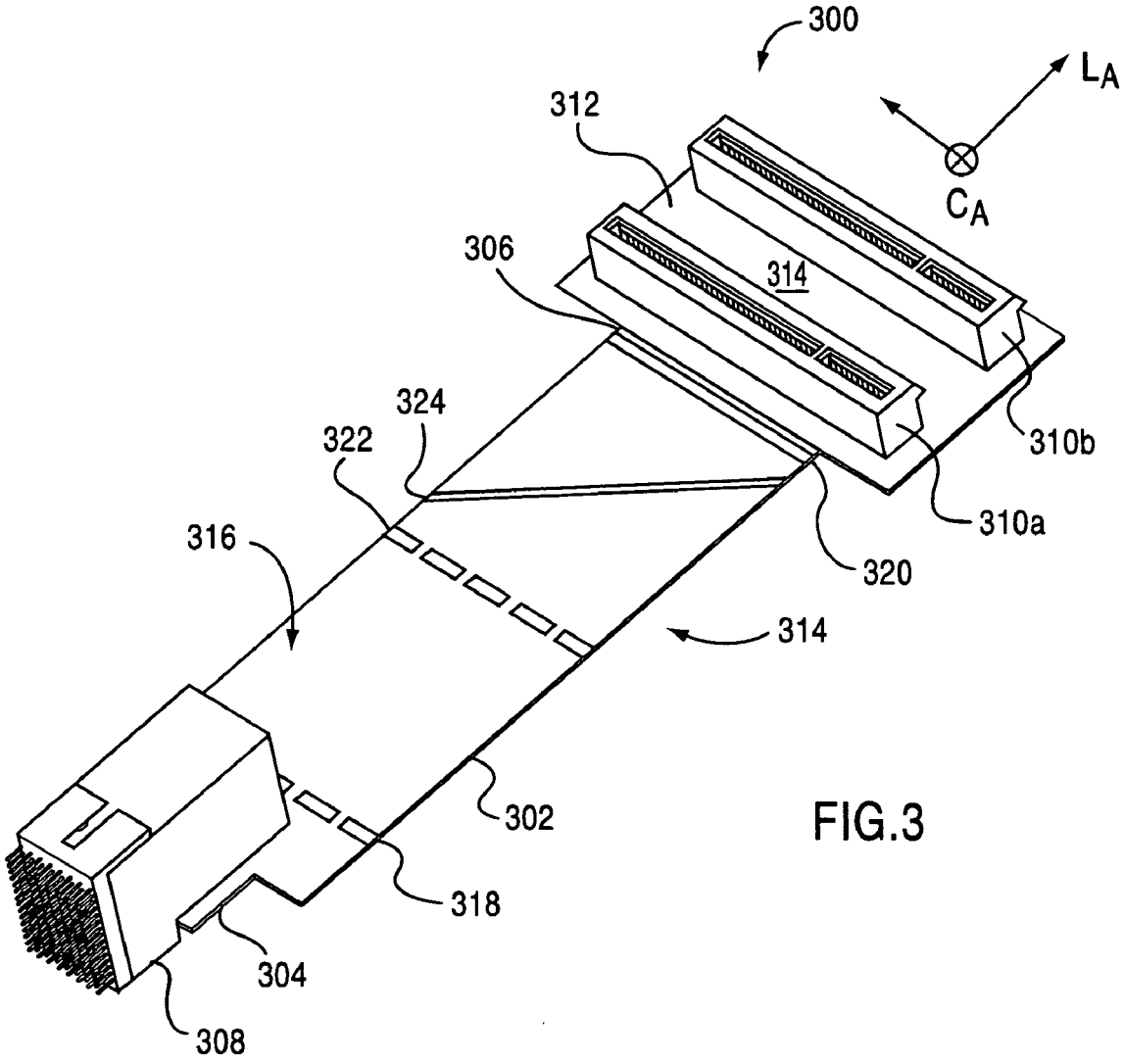
FIG. 3 is a perspective view of an adapter in accordance with an aspect of the present invention.

FIG. 3 depicts an exemplary adapter 300 in accordance with aspects of the present invention. The adapter 300 includes a flexible cable 302 having a first end 304 and a second end 306. A first connector 308 for establishing a connection to a computer is coupled to the flexible cable 302 adjacent the first end 304 and one or more second connectors (represented by a pair of connectors 310*a* and 310*b*) for establishing a connection to cards 100/200 inserted into the computer are coupled to the flexible cable 302 adjacent the second end 306.

The illustrated flexible cable 302 includes a support member 312 having a planar surface 314 that supports and orients the second connectors 310. In an exemplary embodiment, the first connector 308 is a motherboard mating connector used to establish a connection to a corresponding motherboard connector associated with a motherboard of a computer and the second connectors 310 are card mating connector used to establish a connection to a corresponding card inserted into the computer. The second connectors 310 receive the cards along a connection axis ($C_A$), which is perpendicular to the planar surface 314 of the support member in the illustrated embodiment. The flexible cable 302 may be a ribbon cable or other type of signal conductor suitable for passing electronic signals.

The flexible cable 302 may include one or more predefined bends for bending the flexible cable 302 to accommodate different types of cards, e.g., cards 100/200, within a computer. The illustrated flexible cable 302 includes a first side 314, a second side 316, a first predefined bend line 318, a second predefined bend line 320, a third predefined bend line 322, and a fourth predefined bend line 324. Predefined bend lines for bending the flexible cable 302 toward itself on the first side 314 are indicated with dashed lines (i.e., first predefined bend line 318 and third predefined bend line 322) and predefined bend lines for bending the flexible cable 302 toward itself on the second side 316 are indicated with dashed lines (i.e., second predefined bend line 320 and fourth predefined bend line 322).

The first predefined bend line 318 is toward the first end 304 of the flexible cable 302 and the second predefined bend line 320 is toward the second end of the flexible cable 302. The third predefined bend line 322 is between the first and second predefined bend lines 318/320, e.g., at about a mid-point there between. The fourth predefined bend line 324 is between the third and second predefined bend lines 322/320. The first, second, and third predefined bend lines 318/320/322 are substantially perpendicular to a longitudinal axis ($L_A$) of the flexible cable 302 extending between the first end 304 and the second end 306. The fourth predefined bend line 324 is transverse to the third predefined bend line 322. In an exemplary embodiment, the fourth predefined bend line extends across the flexible cable at approximately a 45 degree angle with respect to the longitudinal axis of the flexible cable 302.

In an exemplary embodiment, the flexible cable 302 includes a first set of at least one predefined bend for orienting the second connectors 310 in a first orientation with respect to the first connector 308 and a second set of at least one predefined bend for orienting the second connectors 310 in a second orientation with respect to the first connector 308. In accordance with this embodiment, the first and second orientations are different to accommodate two different types of card within a computer.

Figure 4A:
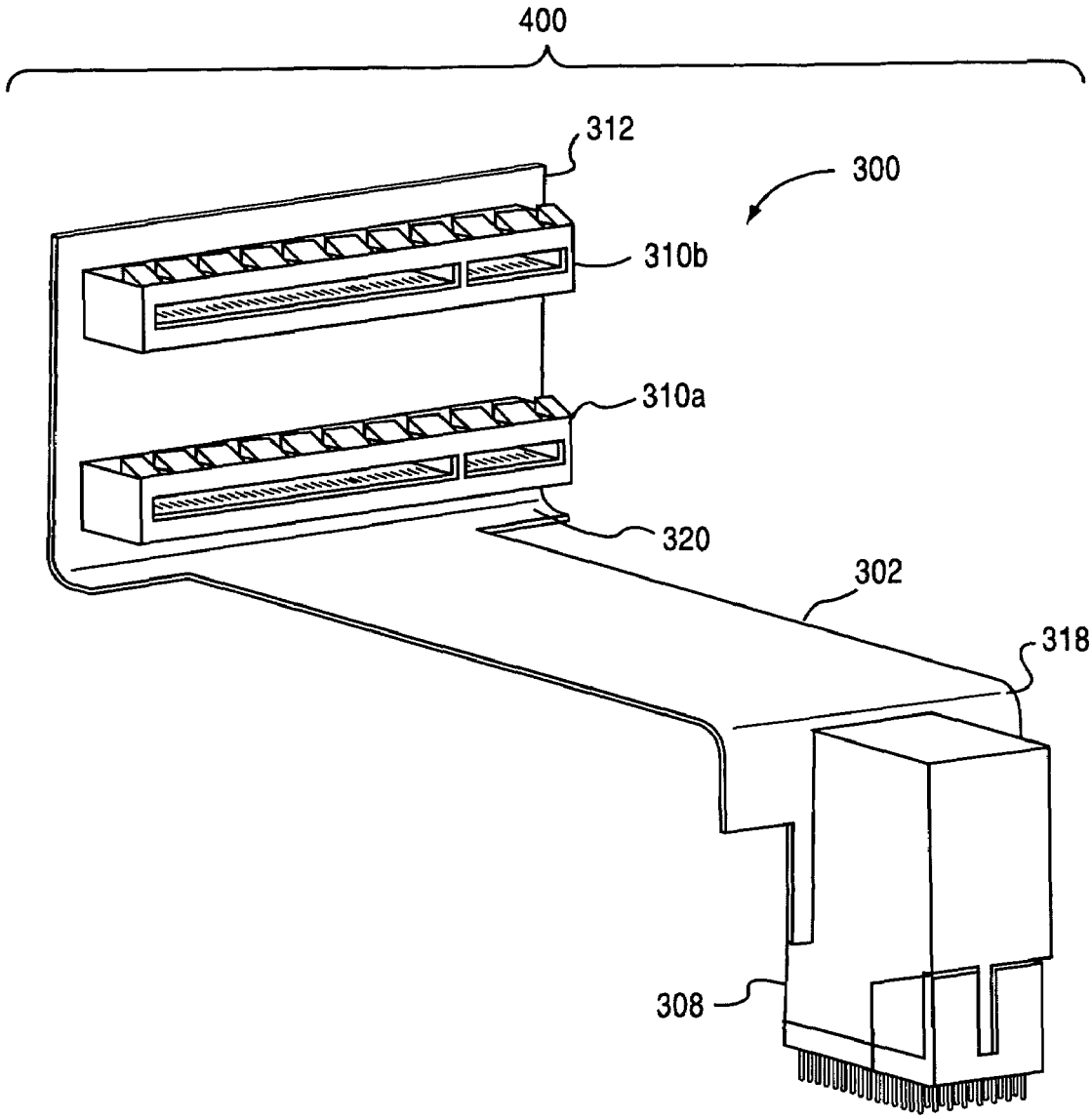
FIG. 4A is a perspective view of the adapter of FIG. 3 bent in a first orientation in accordance with an aspect of the present invention.
Figure 4B:
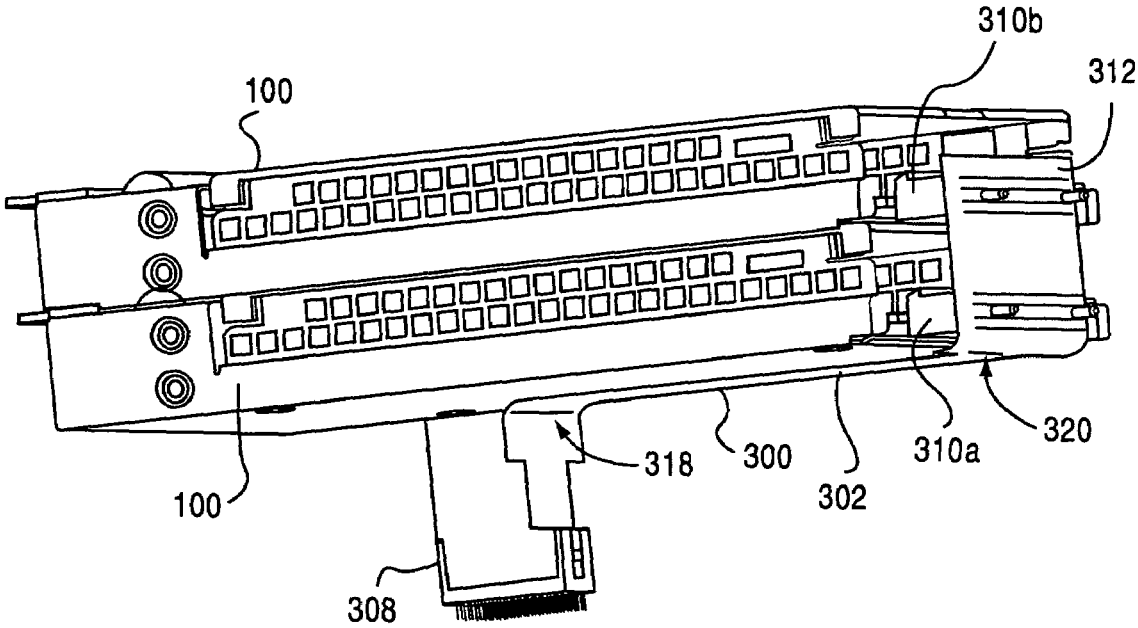
FIG. 4B is a perspective view of the adapter illustrated in FIG. 4A connected to the card of FIGS. 1A ad 1B.

The first set of at least one predefined bend in the exemplary embodiment includes the first predefined bend line 318 and the second predefined bend line 320. The flexible cable 302 may be bent by approximately 90 degrees at each of the first predefined bend line 318 and the second predefined bend line 320 to orient the second connectors 310 in a first orientation with respect to the first connector 308 such as the orientation 400 illustrated in FIGS. 4A and 4B without and with a card 100 connected to the second card connectors 310, respectively.

Figure 5A:
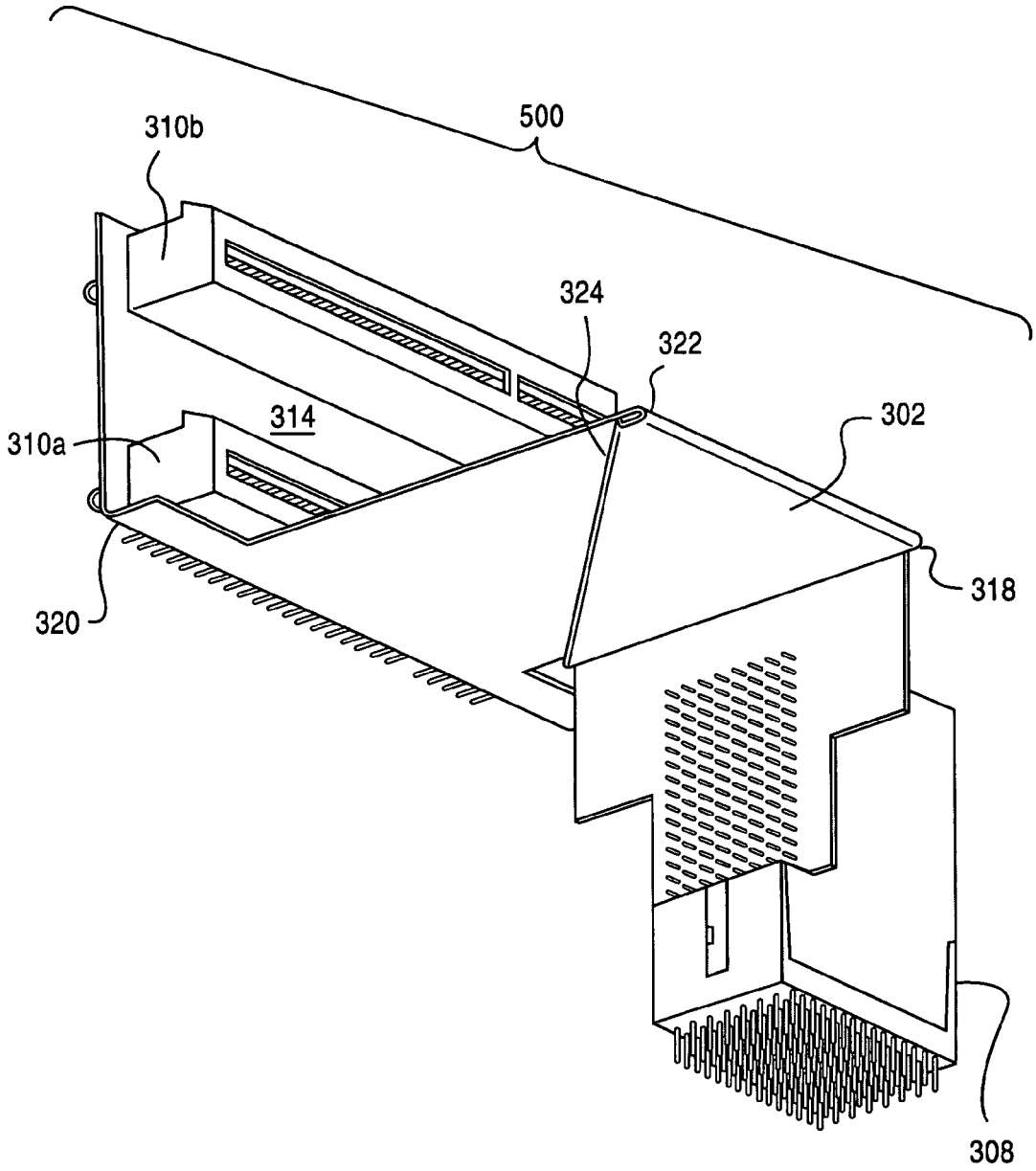
FIG. 5A is a perspective view of the adapter of FIG. 3 bent in a second orientation in accordance with an aspect of the present invention.
Figure 5B:
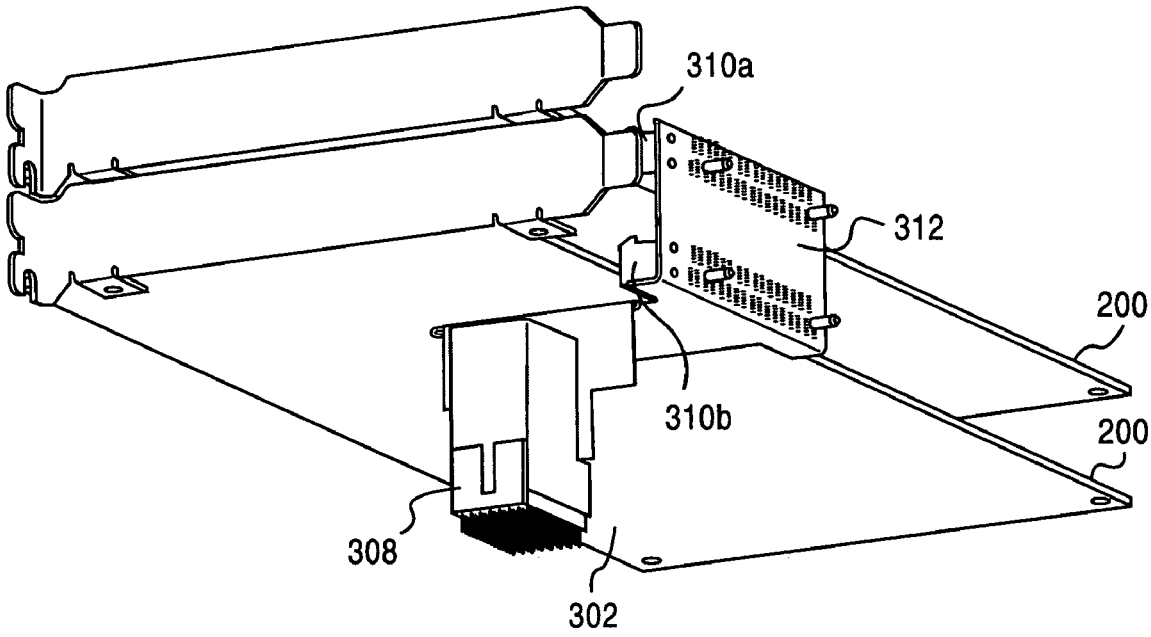
FIG. 5B is a perspective view of the adapter illustrated in FIG. 5A connected to two of the cards of FIG. 2.

The second set of at least one predefined bend in the exemplary embodiment includes the first predefined bend line 318, the second predefined bend line 320, the third predefined bend line 322, and the fourth predefined bend line 324. The flexible cable 302 may be bent by approximately 90 degrees at each of the first predefined bend line 318 and the second predefined bend line 320 and by approximately 180 degrees at each of the third predefined bend line 322 and the fourth predefined bend line 324 to orient the second connectors 310 in a second orientation with respect to the first connector 308 such as the orientation 500 illustrated in FIGS. 5A and 5B without and with cards 200 connected to the second card connectors 310, respectively.

The number, position, and angles of the predefined bend lines described above are for illustrative purposes. Other predefined bend lines will be understood by those of skill in the art from the description herein and are considered to be within the scope of the present invention. For example, three or more sets of predefined bend lines may be employed to orient the second connectors in three or more different orientations with respect to the first connector 308.

Figure 3A:
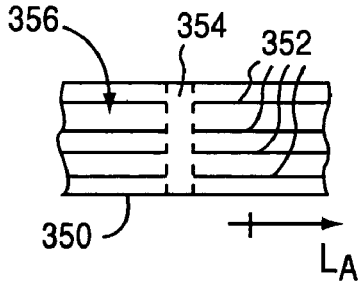
FIG. 3A is a partial top view of a ribbon cable in accordance with an aspect of the present invention.

In an exemplary embodiment, the predefined bend lines may be identified through markings on the surface of the flexible cable 302 such as illustrated in FIG. 3. In an alternative exemplary embodiment, the predefined bend lines may be identified in a separate source such as an instruction booklet (not shown). In an alternative exemplary embodiment, the predefined bend lines may be physical characteristics on a surface of the flexible cable. For example, as illustrated in FIG. 3A, a ribbon cable 350 having ridges 352 extending along a longitudinal axis ($L_A$) of the ribbon cable 350 may have an indentation 354 (e.g., notch) extending across a surface 356 of the ribbon cable 350 at least partway through the ridges 352 to create a predefined bend line. Creating a indentation 354 in the ridges 352 of the ribbon cable 350 predisposes the ribbon cable 350 to bending at the location of the indentation 354. Various other techniques for predisposing the flexible cable 302 to bend at certain locations will be understood by one of skill in the art from the description herein and are considered within the scope of the present invention.

Figure 6:
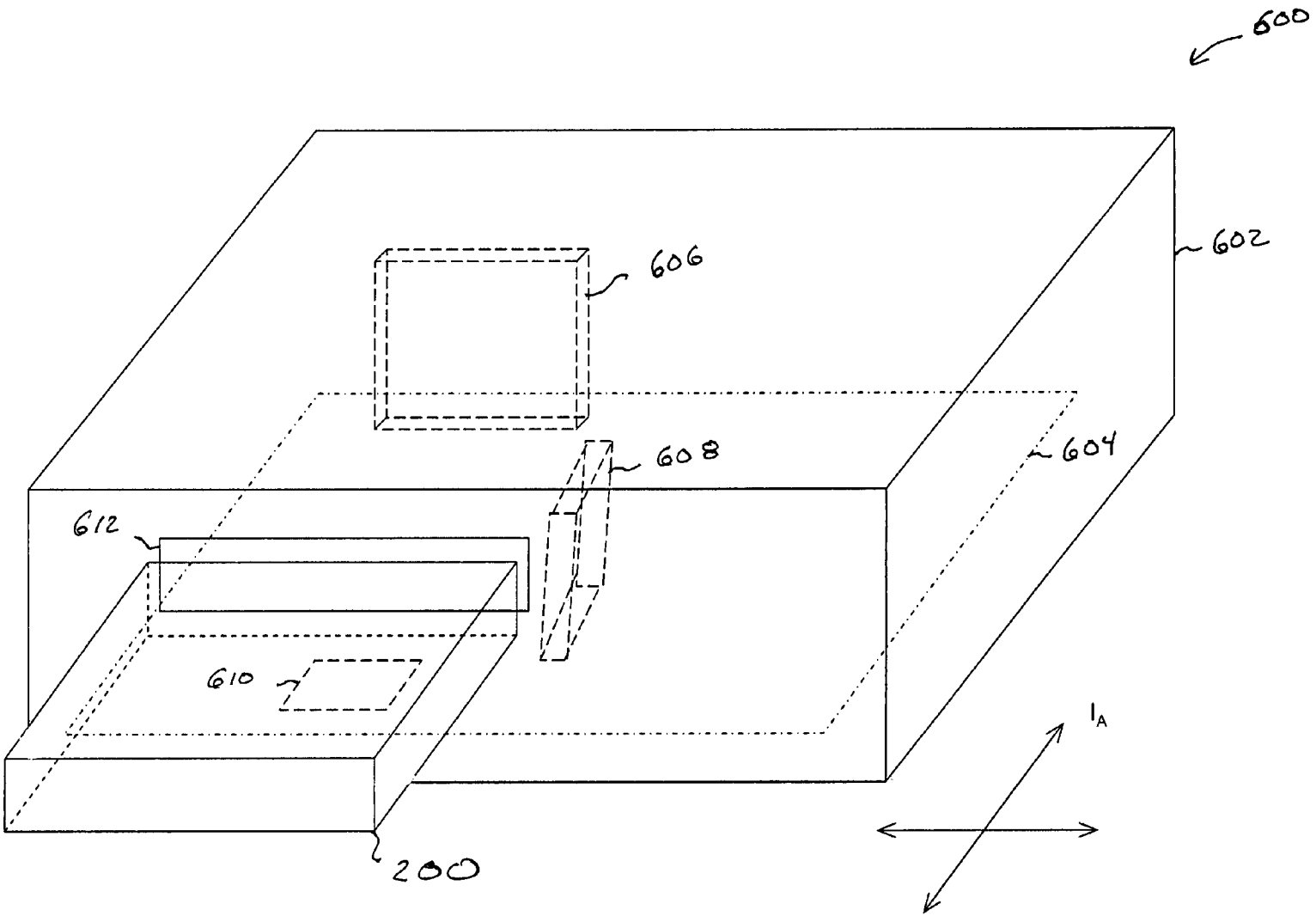
FIG. 6 is a perspective view of a computer in accordance with an aspect of the present invention.

FIG. 6 depicts an exemplary computer 600 in accordance with aspects of the present invention. The computer 600 includes a housing 602 that supports a motherboard 604, a first support structure 606, and a second support structure 608. In an exemplary embodiment, the motherboard 604 includes a motherboard connector 610 that mates with the motherboard mating connector 308 of the adapter 300 (FIG. 3). The housing 602 includes an opening 612 through which the cards 100/200 (FIGS. 1A and 2) may be accessed when the cards 100/200 are present within the computer 600. One or more of the card types may be inserted into the housing 602 through the opening 612 in the housing along an insertion axis ($I_A$). Alternatively, one or more of the card types may be inserted through another opening or by opening a panel (not shown) of the housing 602 and inserting the card.

The first support structure 606 provides support for the second connectors 310 of the adapter 300 (FIG. 3). In an exemplary embodiment, the first support structure 606 attaches to the support member 312 to support and orient the support member 312, which, in turn, orients the second connectors 310. Thus, the first support structure 606 orients the second connectors 310 when the support member 312 is attached to the first support structure 606. The first support structure 606 may be attached to the support member 312 using fasteners such as screws, nuts and bolts, adhesive, corresponding hook and loop mating fastener materials on respective surfaces of the support member 312 and the first support structure 606, etc.

The second support structure 608 provides support for the second connectors 310 of the adapter 300 (FIG. 3). In an exemplary embodiment, the second support structure 608 attaches to the support member 312 to support and orient the support member 312, which, in turn, orients the second connectors. Thus, the second support structure 606 orients the second connectors 310 when the support member 312 is attached to the second support structure 606. The second support structure 606 may be attached to the support member 312 as discussed above for the first support structure 606.

In an exemplary embodiment, the first support structure 606 is positioned within the housing 602 to support the support member 312 such that the second connectors 310 are oriented to receive the card connectors of cards 100 having a connection axis that is parallel to their longitudinal axis. Additionally, the second support structure 608 is positioned within the housing 602 to support the support member 312 such that the second connectors 310 are oriented to receive the card connectors of cards 200 having a connection axis that is perpendicular to their longitudinal axis. In an exemplary embodiment, the first and second support structures 606/608 each have a similar fastener to enable the support member 312 to be separately attached to each of the first and second support structures 606/608.

Figure 7:
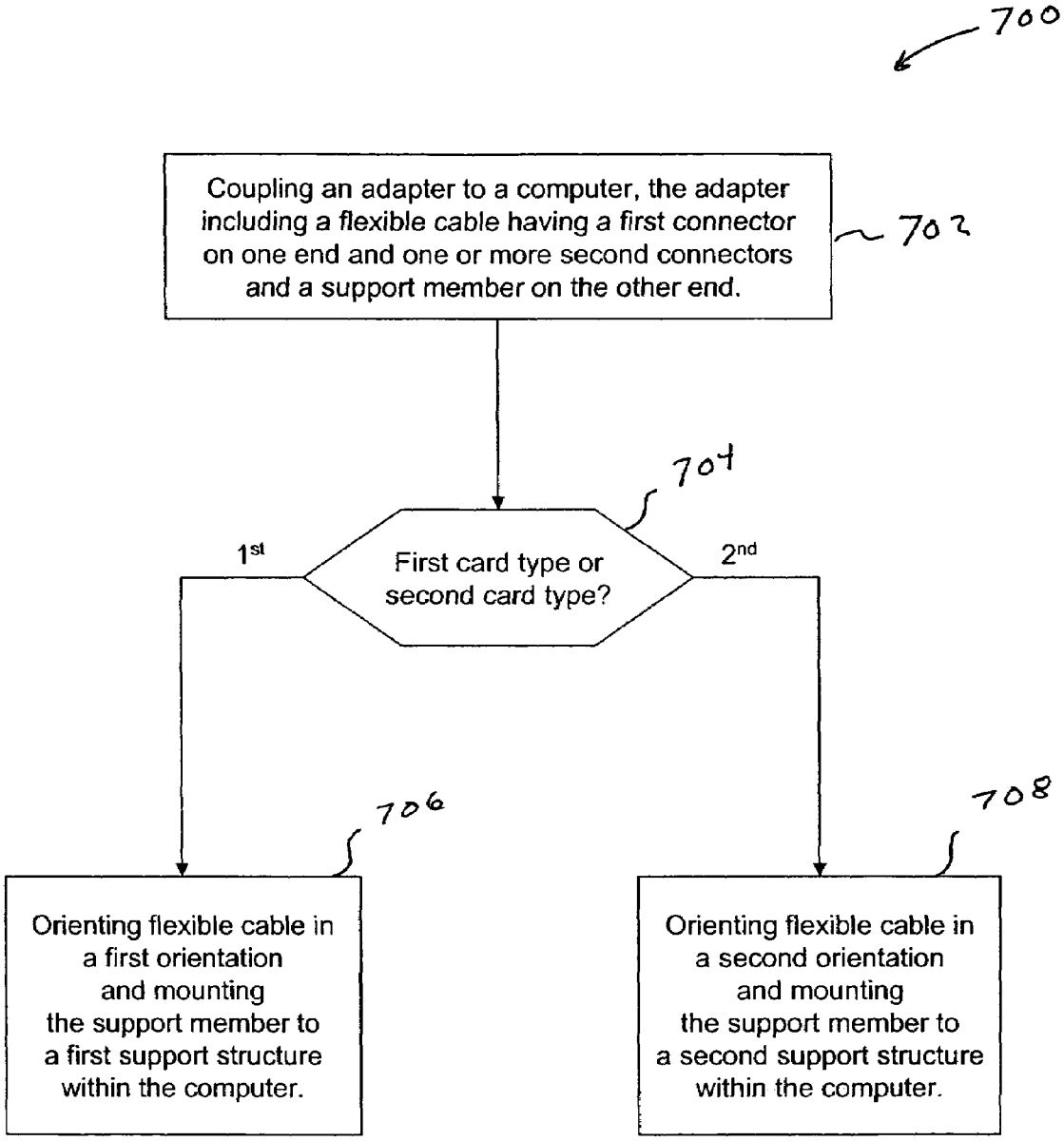
FIG. 7 is a flow chart of exemplary steps for configuring the computer of FIG. 6 using the adapter of FIG. 3 in accordance with an aspect of the present invention.

FIG. 7 depicts a flow chart 700 of exemplary steps to configure a computer to receive one or more cards having at least a first card type (e.g., card 100 of FIG. 1) and a second card type (e.g., card 200 of FIG. 2) in accordance with aspects of the present invention. The exemplary steps are described with reference to FIGS. 3, 4A, 5A, and 6.

At block 702, an adapter 300 is coupled to a computer 600. As described above, the adapter 300 includes a flexible cable 302 having a first end 304 and a second end 306, a first connector 308 adjacent the first end 304 for connection to the computer 600 when the adapter 300 is coupled to the computer 600, one or more second connectors 310 adjacent the second end 306, and a support member 312 adjacent the second end 306 that orients the one or more second connectors 310. In an exemplary embodiment, the adapter is coupled to the computer 600 by connecting the first connector 308 (e.g., a motherboard mating connector) to the motherboard connector 610.

At block 704, a determination is made regarding whether to configured the computer 600 to receive a first card type (e.g., cards 100) or to receive a second card type (e.g., cards 200). If cards of the first card type are determined, processing proceeds at block 706. If cards of the second card type are determined, processing proceeds at block 708.

At block 706, which is reached if cards of the first card type are determined at block 704 (e.g., cards 100), the flexible cable 302 is oriented in a first orientation and the support member 312 is mounted to a first support structure 606 within the computer 600. This configuration orients the second connectors 310 to receive the first card type card connectors 106 when the one or more cards 100 of the first card type are received within the computer 600, e.g., see FIG. 4B.

In an exemplary embodiment, the flexible cable 302 is oriented by bending the flexible cable 302 along predefined bends of the flexible cable 302. The predefined bends may include a first predefined bend line 318 toward the first end 304 for bending the flexible cable 302 toward itself on a first side 314 and a second predefined bend line 320 toward the second end 306 for bending the flexible cable 302 toward itself on the second side 316.

At block 708, which is reached if cards of the second card type are determined at block 704 (e.g., cards 200), the flexible cable 302 is oriented in a second orientation and the support member 312 is mounted to a second support structure 608 within the computer 600. This configuration orients the second connectors 310 to receive the second card type card connectors 208 when the one or more cards 200 of the second card type are received within the computer 600, e.g., see FIG. 5B.

In an exemplary embodiment, the flexible cable 302 is oriented by bending the flexible cable 302 along predefined bends of the flexible cable 302. The predefined bends may include a first predefined bend line 318 toward the first end 304 for bending the flexible cable 302 toward itself on a first side 314 and a second predefined bend line 320 toward the second end 306 for bending the flexible cable 302 toward itself on the second side 316. Additionally, the predefined bends may include a third predefined bend line 322 between the first and second bend lines 318/320 for bending the flexible cable 302 toward itself on the first side 314 and a fourth predefined bend line 324 between the third and second predefined bend lines 322/320 for bending the flexible cable 302 toward itself on the second side 316.

The step of block 702 may be performed after a card type is determined for configuration (block 704) or after orienting the flexible cable and/or mounting the support member to the first/second support structure (blocks 706/708).

Although the invention is illustrated and described herein with reference to specific embodiments, the invention is not intended to be limited to the details shown. For example, the cards 100/200 described above are for illustrative purposes and other types of cards having different shapes and/or connectors on different edges are considered within the scope of the present invention. Various other modifications may be made in the details within the scope and range of equivalents of the claims and without departing from the invention.

What is claimed is:

1. An adapter for use with a computer, the adapter comprising:

a first connector;

a second connector; and a flexible cable having a first end and a second end, the first connector coupled to the flexible cable adjacent the first end and the second connector coupled to the flexible cable adjacent the second end, the flexible cable including a first set of at least one predefined bend for orienting the second connector in a first orientation with respect to the first connector and a second set of at least one predefined bend for orienting the second connector in a second orientation with respect to the first connector, the first and second orientations being different.

2. The adapter of claim 1, wherein the computer includes a first support structure and a second support structure, the adapter further comprising:

a support member adjacent the second end of the flexible cable, the support member providing support for the second connector, the support member configured for separate attachment to each of the first support structure and the second support structure.

3. An adapter for use with a computer, the computer including a first support structure and a second support structure, the adapter comprising:

a first connector;

a second connector;

a flexible cable having a first end and a second end, the first connector coupled to the flexible cable adjacent the first end and the second connector coupled to the flexible cable adjacent the second end, the flexible cable including a first set of at least one predefined bend for orienting the second connector in a first orientation with respect to the first connector and a second set of at least one predefined bend for orienting the second connector in a second orientation with respect to the first connector, the first and second orientations being different; and a support member adjacent the second end of the flexible cable, the support member providing support for the second connector, the support member configured for separate attachment to each of the first support structure and the second support structure, wherein bending the flexible cable along the first set of at least one predefined bend and attaching the support member to the first support structure configures the computer to receive one or more cards of a first card type and wherein bending the flexible cable along the second set of at least one predefined bend and attaching the support member to the second support structure configures the computer to receive one or more cards of a second card type.

4. The adapter of claim 3, wherein the first connector is a motherboard mating connection and wherein the first card type is a Peripheral Component Interface Express (PCIe) card and the second card type is a PCIe ExpressModule assembly.

5. The adapter of claim 1, wherein the flexible cable has a first side and a second side opposite the first side and wherein the first set of at least one predefined bend includes a first predefined bend line toward the first end for bending the cable toward itself on the first side and a second predefined bend line toward the second end for bending the cable toward itself on the second side.

6. The adapter of claim 5, wherein the second set of at least one predefined bend includes the first and second predefined bend lines, a third predefined bend line between the first and second bend lines for bending the cable toward itself on the first side, and a fourth predefined bend line between the third and second predefined bend lines for bending the cable toward itself on the second side, the fourth predefined bend line being transverse to the third predefined bend line.

7. The adapter of claim 6, wherein the first, second, and third bend lines are substantially perpendicular to a longitudinal axis of the flexible cable extending between the first and second ends, the third bend line is approximately midway between the first and second ends, and the fourth bend line is approximately 45 degrees to the longitudinal axis.

8. The adapter of claim 6, wherein the flexible cable is a ribbon cable and the first and second set of predefined bends include indentations in the surface of the ribbon cable.

* * * * *